United States Patent [19]

Morris et al.

[11] Patent Number: 4,541,191

[45] Date of Patent: Sep. 17, 1985

[54] WEAPON HAVING A UTILIZATION RECORDER

[76] Inventors: Ernest E. Morris, 4400 N. Benton Ct.; Donald J. Young, 4835 E. State Rd. 46, both of Bloomington, Ind. 47401

[21] Appl. No.: 597,541

[22] Filed: Apr. 6, 1984

[51] Int. Cl.[4] ..... F41C 27/00

[52] U.S. Cl. ..... 42/1 A; 42/1 R

[58] Field of Search ..... 42/1 E, 1 A, 1 R

[56] References Cited

U.S. PATENT DOCUMENTS 3,453,882 7/1969 Kirkendall et al. ..... 42/1 A 3,785,261 1/1974 Ganteaume ..... 42/1 A

*Primary Examiner*—Charles T. Jordan

*Attorney, Agent, or Firm*—Woodard, Weikart, Emhardt & Naughton

[57] ABSTRACT

Described is a weapon including a utilization recorder having a detector for detecting activation of the weapon and producing an activation signal upon detection, a control module for generating a time signal representative of elapsed time and for causing the time signal to be sent to a recording module upon receipt by the control module of an activation signal, and a recording module having multiple memories for recording the time signal.

5 Claims, 1 Drawing Figure

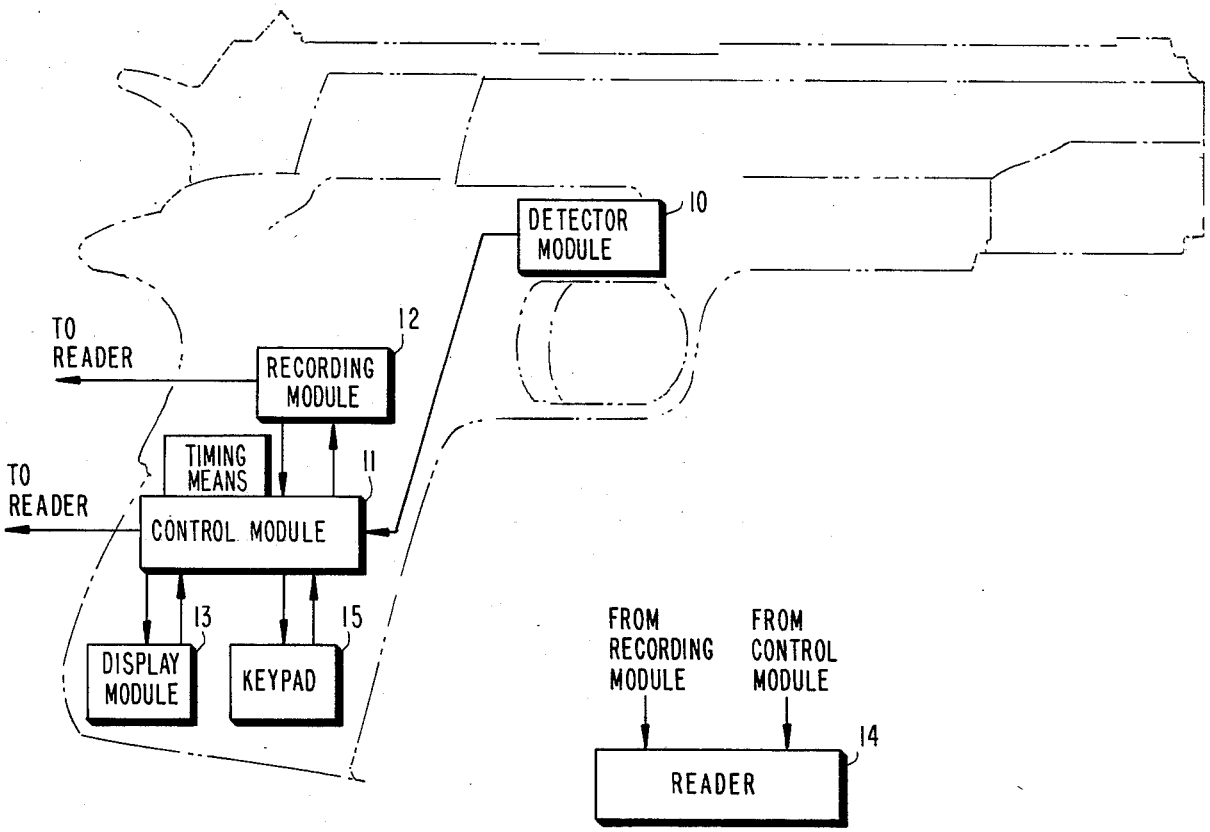
DETECTOR MODULE
10
TO READER
RECORDING MODULE
12
TIMING MEANS
11
TO READER
CONTROL MODULE
13
15
DISPLAY MODULE
KEYPAD
FROM RECORDING MODULE
FROM CONTROL MODULE
14
READER

WEAPON HAVING A UTILIZATION RECORDER

BACKGROUND OF THE INVENTION

This invention relates to the field of hand-held weapons having means for producing an impact upon a target, and particularly to a hand-held weapon having means for recording the time at which the impact producing means is activated.

Various hand-held weapons for producing an impact upon a target are known. The most common of such weapons are pistols configured to expel at high speed one or more projectiles by means of an explosive combustion. Another common weapon in this class is the "nightstick" or "billy club".

Because pistols and clubs are the principal weapons used by police officers to defend themselves and to apprehend criminal suspects, and because such weapons are by their nature likely to cause great bodily injury or death to persons to whom they are directed, it is in society's interest to be able to document as many details surrounding the use of such weapons as is possible. It is sometimes of critical importance to know exactly when a weapon was used in order to determine whether such use was justified under the circumstances. Thus, it would be desirable for hand-held weapons, especially those used by police officers, to be provided with a means for automatically recording the time of use of each weapon. The routine use by police of such recording means could prevent the miscarriage of justice and help clear up questions of police brutality.

SUMMARY OF THE INVENTION

One embodiment of the present invention involves a hand-held weapon having a handle and means for producing an impact upon a target. The improvement in combination therewith includes a weapon utilization recorder having a timing means for producing a time signal representative of elapsed time, a recording means for recording the time signal, a detecting means for detecting the activation of the impact producing means and for producing an activation signal upon detection, and controlling means for causing the time signal to pass to the recording means upon receipt of the activation signal by the controlling means, whereby there is provided a record of the time at which the impact producing means of the weapon is activated.

It is an object of the present invention to provide an improved weapon which automatically records the time at which the weapon is utilized.

BRIEF DESCRIPTION OF THE DRAWINGS

The drawing shows a block diagram of the modules of the present invention and the general positions of the modules in combination with a conventional weapon.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawing, there is shown a block diagram of the modules of the weapon utilization recorder of the present invention in combination with a conventional hand-held weapon. The principal components are a detector 10, a control module 11, a recording module 12, a display module 13, a reader 14 and a keypad 15. Control module 11, recording module 12, display module 13 and keypad 15 are located in the handle of the weapon, with detector 10 being located elsewhere in the weapon, depending upon the phenomenom to be detected, as will be explained below. Reader 14 is located externally of the weapon.

Power for the circuitry of the weapon utilization recorder is provided by a long-life type battery (such as nickel cadmium) located in the handle of the weapon.

A brief description of the operation of the weapon utilization recorder is as follows: Detector 10 detects the activation of the impact producing means, such as the movement of a pistol's trigger, and sends an activation signal to control module 11. Upon receipt of an activation signal control module 11 causes an internally generated signal which is representative of elapsed time to be sent to a memory location in recording module 12. The time signal thus recorded is permanently stored in recording module 12 and may thereafter be read by external reader 14 or, upon request via keypad 15, may be read by control module 11 and sent to display module 13 where it is displayed alpha-numerically by means of a conventional LCD or LED display.

Detector 10 is any suitable transducer for detecting utilization of the weapon. For example, it may be an accelerometer for detecting the recoil of a pistol or the striking of a club against an object. Another suitable transducer would be a simple mechanical switch for detecting motion of the trigger or slide mechanism, or the rotation of the cylinder of a pistol. The detector may also be a pressure transducer for detecting gas discharge. The detector, whatever its form, produces an activation signal upon detection which is recognizable by the control module. Although only one detector is indicated in the drawing, it is to be understood that multiple detectors may be employed in series or in parallel to prevent false activation signals.

Control module 11 is preprogrammed to receive and interpret activation signals, generate time signals, generate display signals, and transfer the time signal to the recording module upon receipt and recognition of an activation signal. The time signal generated is representative of elapsed time, and preferably represents the year, month, day, hour and second. Control module 11 is also encoded with a serial number which may be read by reader 14 for identification. Additional functions of control module 11 are a low battery detector and an activation counter. Low battery condition and total number of activations recorded are displayed by display module 13 upon request via keypad 15.

Recording module 12 includes a plurality of memory locations, each one capable of permanently storing a time signal. Each time an activation signal is received by the control module, it sends the time signal to a different memory location in the recording module, thus allowing recordation of a number of weapon utilizations. Recording module 12 is also provided with an encoded serial number which may be read by reader 14.

External reader 14, when connected to recording module 12 and control module 11, will read serial numbers and time data stored therein. The reader typically would be located at the police station or other central location, and would be used periodically to determine the utilization status of the weapon.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. In a hand-held weapon having a handle and means for producing an impact upon a target, the improvement in combination therewith comprising:

timing means, having an output, for producing a time signal at the output representative of elapsed time, said elapsed time representative time signal being representative of the time of day and date;

recording means, having an input and an output, for recording a signal present at the input;

detecting means, having an output, for detecting the activation of the impact producing means, said detector means producing an activation signal at the output upon detection; and controlling means, having inputs coupled to the outputs of said timing means and said detector means and having an output coupled to the input of said recording means, for causing the time signal to pass to the input of said recording means upon receipt of the activation signal at the input of said controlling means, whereby there is provided a record of the time at which the impact producing means of said weapon is activated.

2. The weapon of claim 1, wherein said detecting means is a pressure transducer configured to detect gas discharge of the weapon.

3. In a hand-held weapon having a handle and means for producing an impact upon a target, the improvement in combination therewith comprising:

timing means, having an output, for producing a time signal at the output representative of elapsed time;

recording means, having an input and an output, for recording a signal present at the input;

detecting means, having an output, for detecting the activation of the impact producing means, said detector means producing an activation signal at the output upon detection; and controlling means, coupled to and programmable from a keypad, having inputs coupled to the outputs of said timing means, said detector means and said recording means, and having an output coupled to the input of said recording means, for causing the time signal to pass to the input of said recording means upon receipt of the activation signal at the input of said controlling means, and further for reading the signal recorded in said recording means and sending the recorded signal as read to a display means when demanded via the keypad, whereby there is provided a record of the time at which the impact producing means of said weapon is activated, the recorded time being displayable upon demand.

4. The weapon of claim 3, wherein said timing means produces a time signal representative of the time of day and date.

5. The weapon of claim 3, wherein said detecting means is a pressure transducer configured to detect gas discharge of the weapon.

* * * * *